US007249741B1

(12) United States Patent
Larson

(10) Patent No.: US 7,249,741 B1
(45) Date of Patent: Jul. 31, 2007

(54) PEDESTALS WITH S-SHAPED BASES

(76) Inventor: John Larson, P.O. Box 1197, Hamilton, MT (US) 59840

( * ) Notice: Subject to any disclaimer, the term of this patent is extended or adjusted under 35 U.S.C. 154(b) by 274 days.

(21) Appl. No.: 10/995,617

(22) Filed: Nov. 22, 2004

Related U.S. Application Data

(63) Continuation-in-part of application No. 10/315,372, filed on Dec. 9, 2002, now abandoned, which is a continuation-in-part of application No. 09/566,212, filed on May 5, 2000, now Pat. No. 6,491,269, which is a continuation-in-part of application No. 09/348,618, filed on Jul. 6, 1999, which is a continuation-in-part of application No. 09/173,236, filed on Oct. 15, 1998, now Pat. No. 6,182,583.

(51) Int. Cl.
*F16M 11/20* (2006.01)
*A47B 13/02* (2006.01)

(52) U.S. Cl. ..... 248/188.1; 108/150; 108/157.17

(58) Field of Classification Search ..... 248/188.1, 248/127, 188.5; 108/147, 150, 158.11, 157.17
See application file for complete search history.

(56) References Cited

U.S. PATENT DOCUMENTS 1,809,603 A * 6/1931 Reed ..... 248/628
3,267,881 A * 8/1966 Saggione ..... 108/59
D223,838 S * 6/1972 Valic ..... D6/423
4,052,081 A * 10/1977 Becker, III ..... 280/79.3
D248,912 S * 8/1978 Canfield et al. ..... D6/421
5,301,968 A * 4/1994 Ward et al. ..... 280/87.021
5,483,904 A * 1/1996 Kelly et al. ..... 108/156
D376,447 S * 12/1996 Stump ..... D30/144
D412,625 S * 8/1999 Montague et al. ..... D6/421
6,044,794 A * 4/2000 Raitanen et al. ..... 119/28.5
6,234,437 B1 * 5/2001 Cabo ..... 248/220.22
6,413,349 B1 * 7/2002 Cannata ..... 156/264
6,938,864 B2 * 9/2005 Simonian et al. ..... 248/200
7,028,957 B1 * 4/2006 Larson ..... 248/188.5

FOREIGN PATENT DOCUMENTS

GB 2098472 A * 11/1982

OTHER PUBLICATIONS webpage http://www.furnitureny.com/product.asp?ProductID=31&CategoryID=313&Name-Curl, dated Jun. 30, 2005, original posting date unknown.

* cited by examiner

*Primary Examiner*—Anita M. King

(57) ABSTRACT

A pedestal has an S-shaped base and an upwardly extending member to support a furniture component. The S-shaped base provides an open leg envelope for persons seated at the pedestal. Workers at the pedestal's S-shaped table face opposite directions and enjoy independent work spaces.

10 Claims, 14 Drawing Sheets

PEDESTALS WITH S-SHAPED BASES

CROSS-REFERENCE TO RELATED APPLICATIONS

The subject application is a continuation-in-part of application Ser. No. 10/315,372, filed Dec. 9, 2002 now abandoned which was a continuation-in-part of application Ser. No. 09/566,212, filed May 5, 2000, now U.S. Pat. No. 6,491,269 and also a continuation-in-part of application Ser. No. 09/348,618, filed Jul. 6, 1999; which was a continuation-in-part of application Ser. No. 09/173,236, filed Oct. 15, 1998, now U.S. Pat. No. 6,182,583. The disclosures of each of these documents are hereby incorporated by reference in their entireties, including all figures, tables and drawings.

BACKGROUND OF THE INVENTION

As offices and classrooms become more crowded, it is important that workers and students retain a personal space. Open concept offices and classrooms maximize the use of limited space as well as encourage creativity and teamwork. It is the individuality of each member however that contributes to the success of a team. Therefore, in an open environment it is important to retain a measure of individual space. Sharing desk space may not provide each worker personal space. Desks that are constructed to accommodate multiple workers yet provide each worker individual space and a sense of privacy would nurture the most important aspect of any team, the individual.

All patents, patent applications, provisional patent applications and publications referred to or cited herein, are incorporated by reference in their entirety to the extent they are not inconsistent with the explicit teachings of the specification.

SUMMARY

The subject invention involves pedestals with S-shaped bases that can be tables and benches. The S-shape allows two persons to access and share a table without crowding of personal space. A table top supported on the S-shaped base of the pedestal of the subject invention provides an open leg envelope for each worker seated at the table top therefore accommodating those seated in a wheelchair.

DETAILED DESCRIPTION OF THE INVENTION

The subject invention involves a pedestal for tables and benches. The pedestal has a S-shaped base allowing a table top or bench seat supported on the base to accommodate more than one person. Persons using the tables or benches do not interfere with each other's activity.

Figure 1:
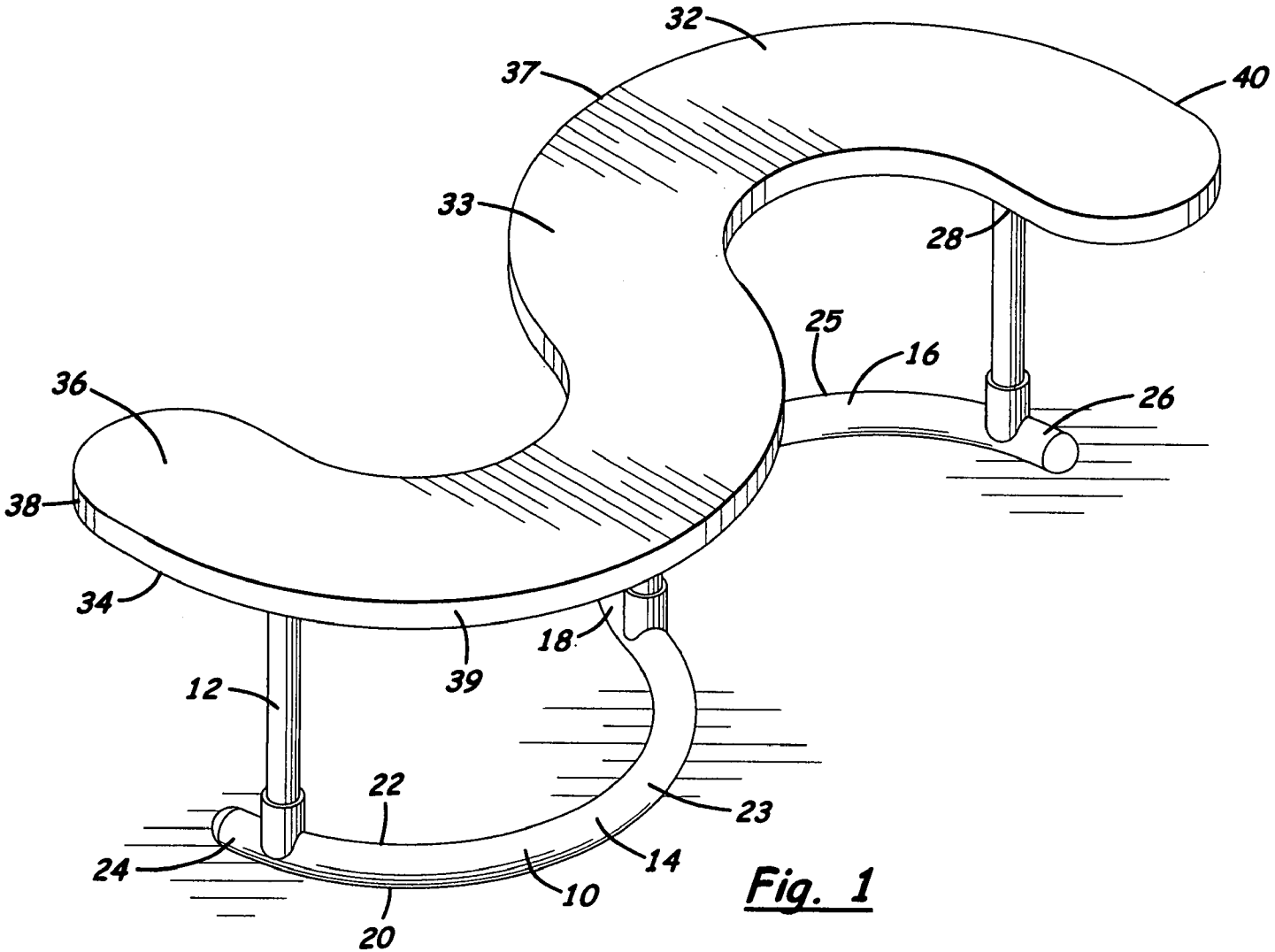
FIG. 1 shows a perspective view of a preferred embodiment of the pedestal of the subject invention.

A preferred embodiment of the pedestal of the subject invention is shown in FIG. 1. The pedestal has an S-shaped base 10 supporting at least one upwardly extending furniture support member 12. The base 10 has a first arcuate section 14 which opposes a second arcuate section 16. The first and second arcuate sections intersect at a middle section 18. The base has a first side 20 which faces away from a second side 22. Orthogonal to the first and second side 20, 22, respectively, are first and second ends, 24, 26 of the S-shaped base. The base 10 further has opposing ends 23, 25.

The upwardly extending furniture support member 12 is supported by the S-shaped base 10. Each member has an upper end 28 and a lower end 30. The lower end 30 of the support member 12 is supported by the base 10.

The subject pedestal further comprises a furniture component support 32. In the embodiment shown in FIG. 1, the furniture component support 32 is a table top 33. The furniture component support has a first side 34 and a second side 36 which faces away from the first side 34. The furniture component support has first and second opposing ends 38, 40 orthogonal to the first and second sides 34, 36, respectively. The furniture component support has opposing ends 37,39.

Figure 2:
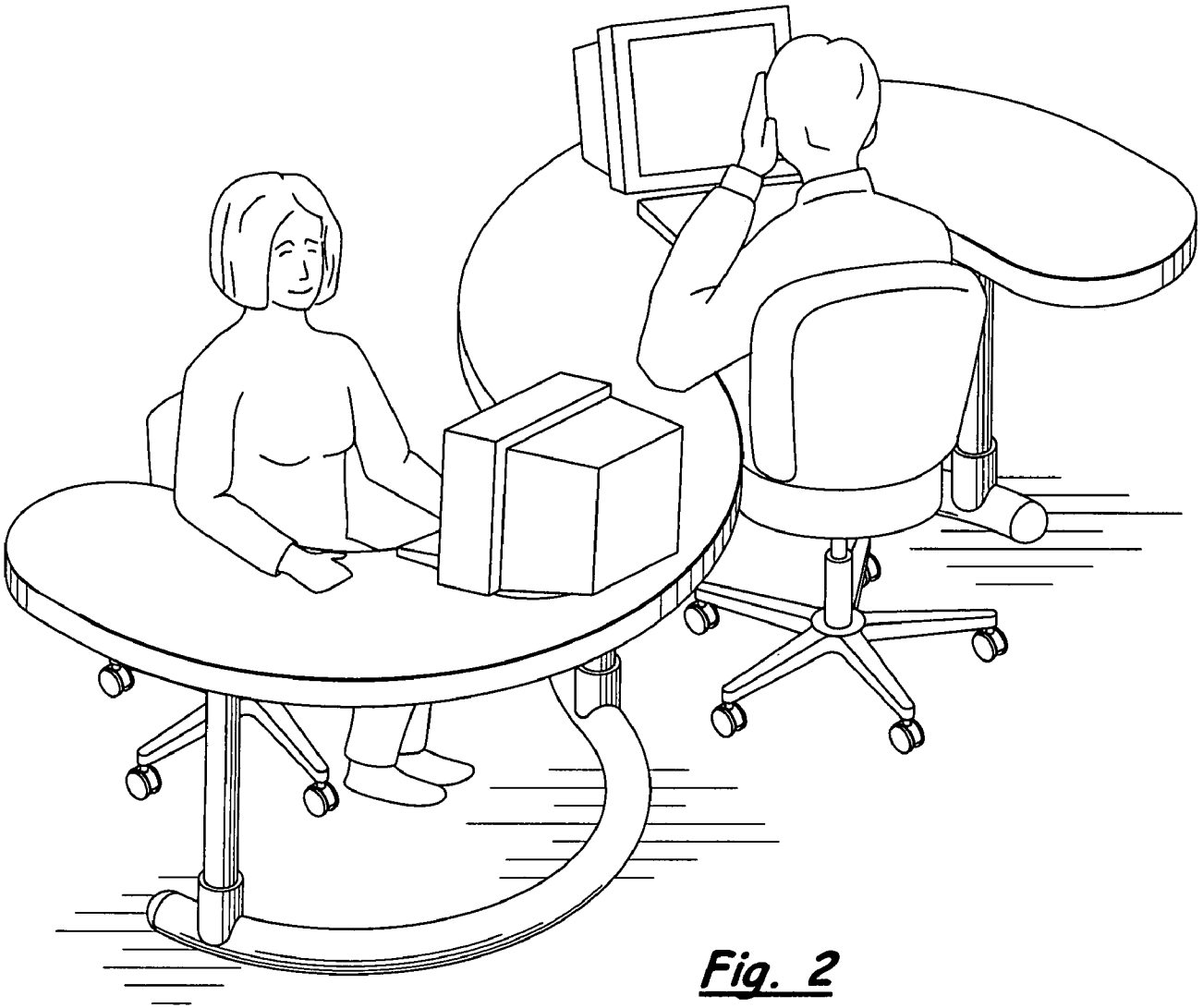
FIG. 2 shows a perspective view of the preferred embodiment of the pedestal shown in FIG. 1 in use.
Figure 3:
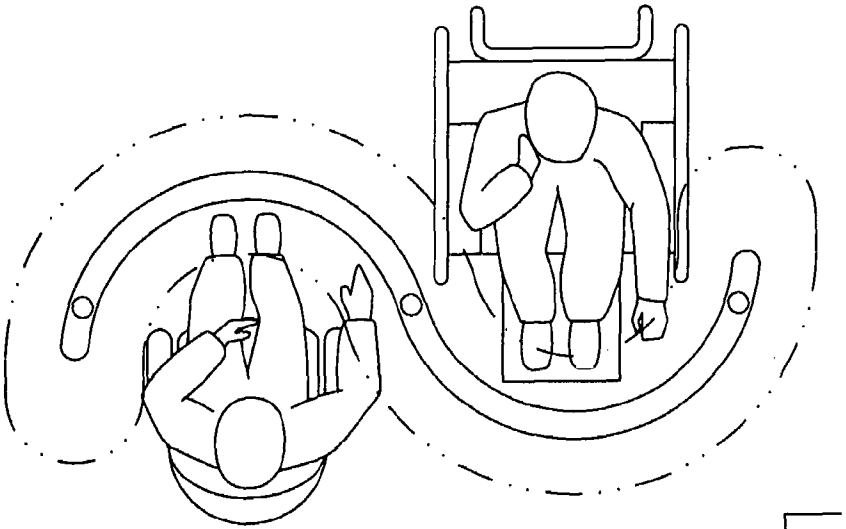
FIG. 3 shows a top sectional view along line A-A of the preferred embodiment of the pedestal shown in FIG. 1, in use.
Figure 4:
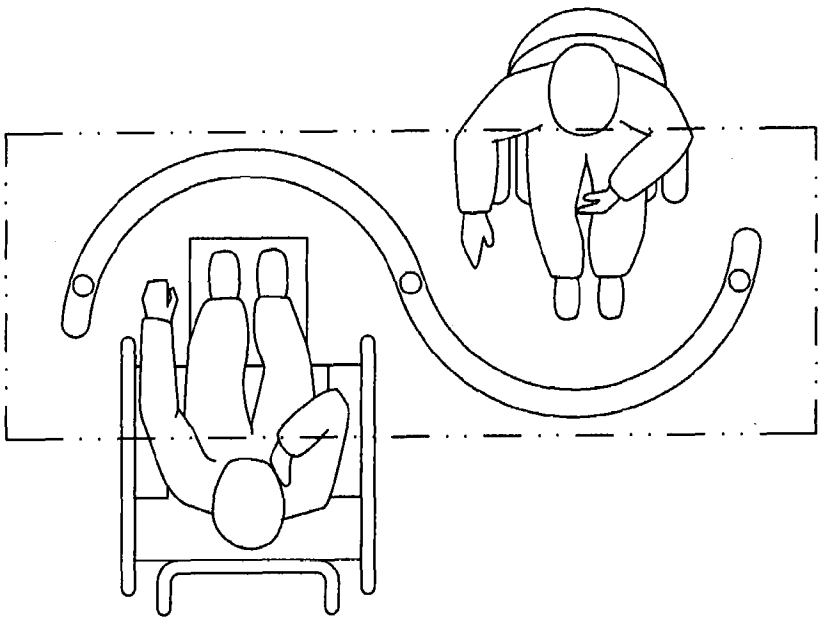
FIG. 4 shows a top sectional view of another preferred embodiment of the pedestal of the subject invention.

FIG. 2 shows two workers seated at the pedestal shown in FIG. 1. The workers face opposite directions when seated at the table. Therefore, although the subject pedestal accommodates two workers, the workers retain a private work space. FIG. 4 shows a sectional top view of the subject pedestal illustrating that the pedestal provides an open leg envelope to accommodate wheelchairs.

Figure 5:
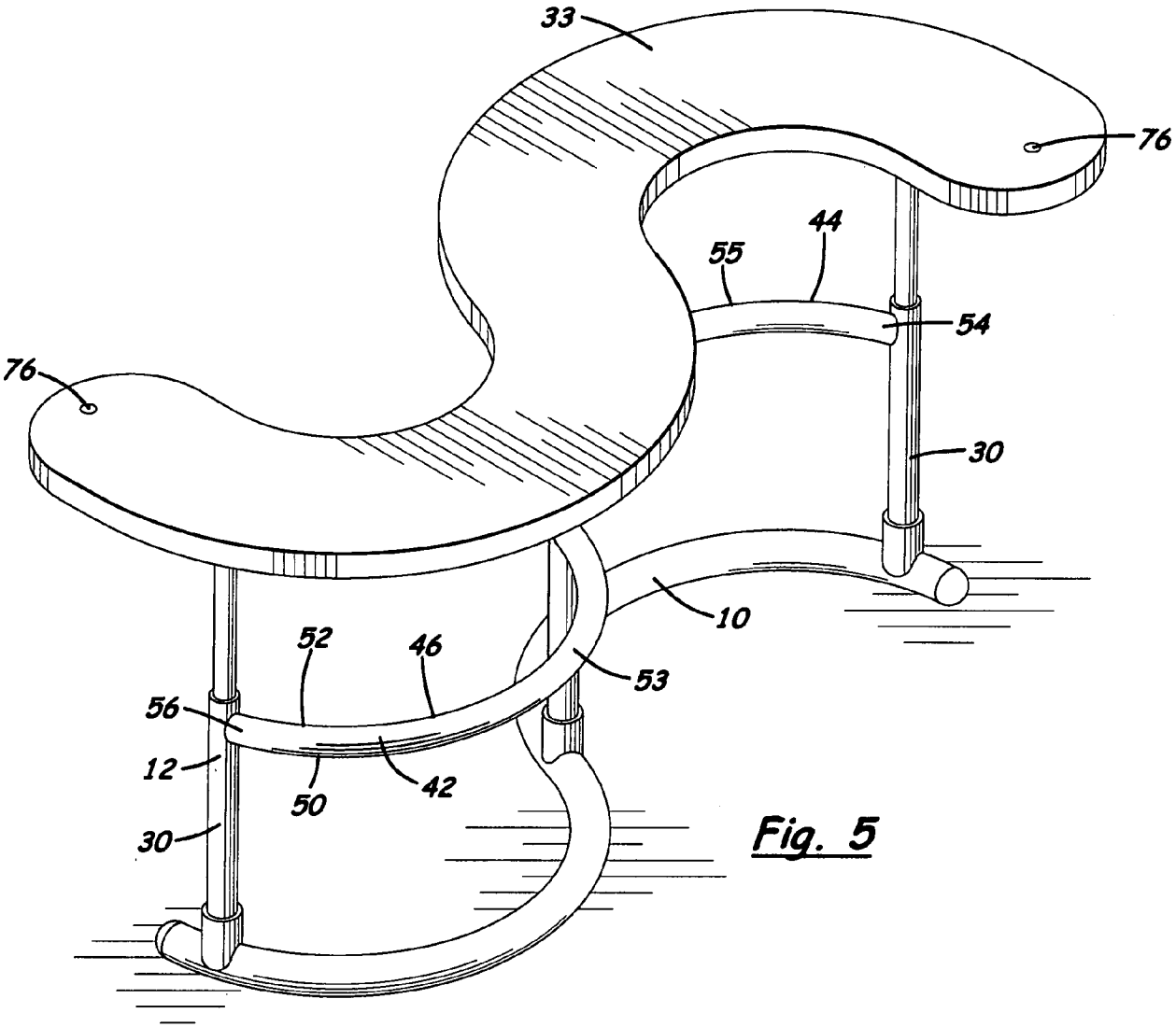
FIG. 5 shows a perspective view of another preferred embodiment of the pedestal of the subject invention.

FIG. 5 shows another preferred embodiment of the pedestal of the subject invention. This embodiment has an S-shaped furniture frame member 42. The S-shaped furniture frame member 42 has a first arcuate section 44 opposing a second arcuate section 46, the first and second arcuate sections intersecting at a middle section 48. The frame member 42 has a first side 50 which faces away from a second side 52. The frame member 42 further has first and second opposing ends 54, 56 disposed orthogonal to the first and second sides 50, 52, respectively. The furniture frame member further has opposing ends 53, 55. The frame member 42 connects the upwardly extending support members 12.

Figure 6:
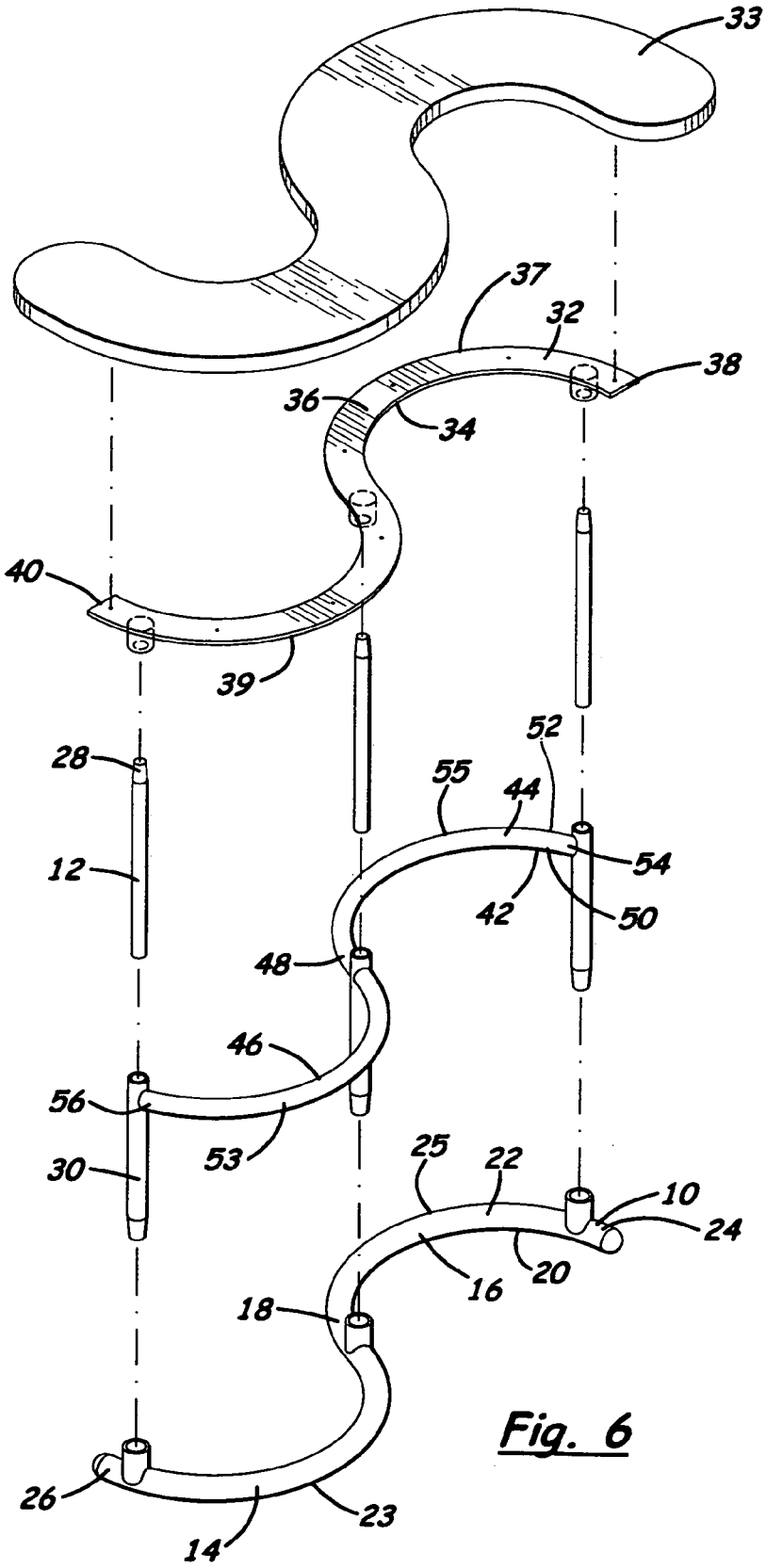
FIG. 6 shows an exploded view of the embodiment shown in FIG. 5.
Figure 7:
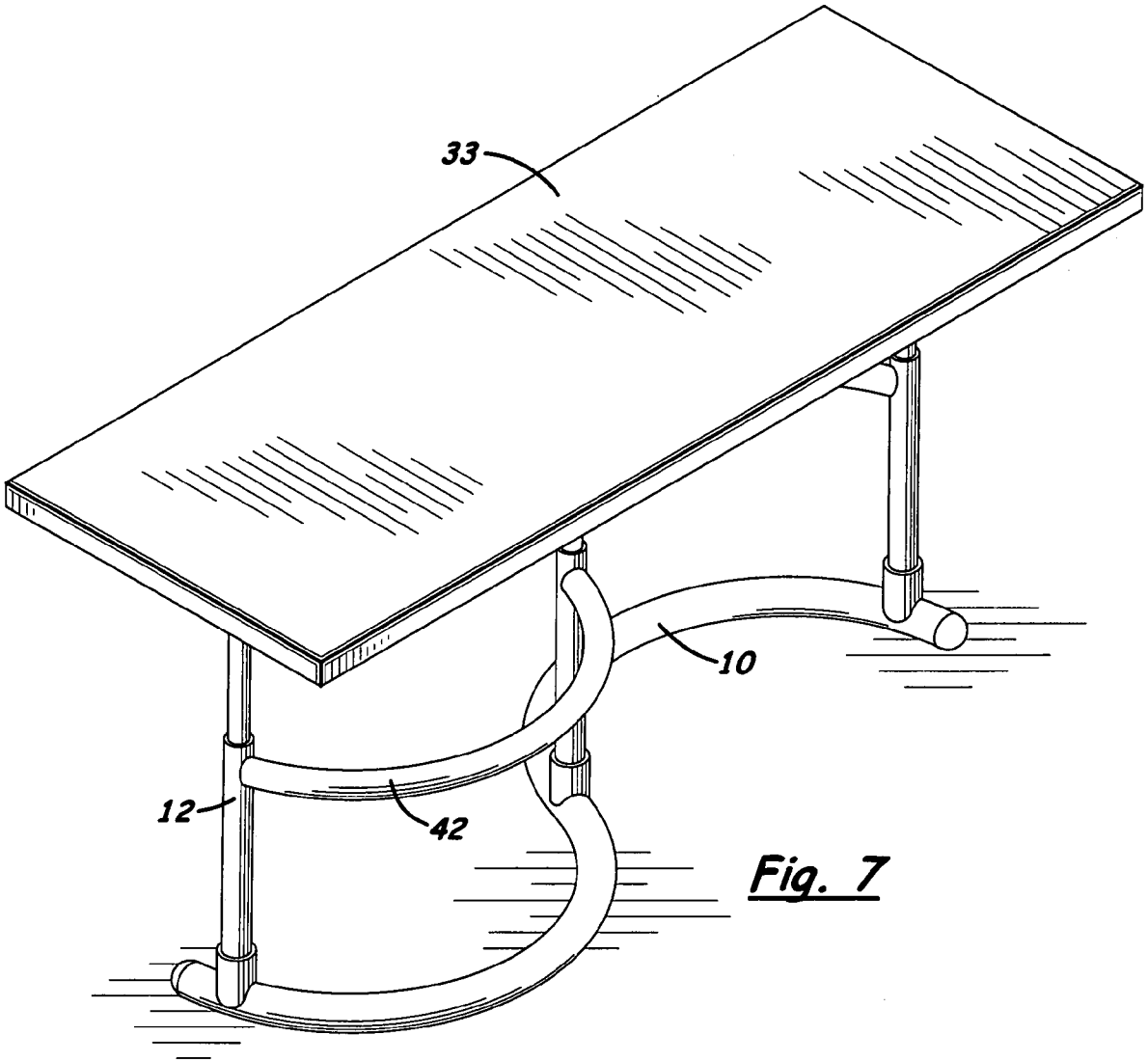
FIG. 7 shows a perspective view of another preferred embodiment of the pedestal of the subject invention.

An exploded view of the pedestal of FIG. 5 is shown in FIG. 6. The furniture component support 32 is S-shaped and supports a table top 33. The S-shaped frame member 42 connects the lower ends 30 of furniture support members 12 for additional support FIG. 7 shows that the furniture component supported on the base can be any shape. In this embodiment, the component is a rectangular table top 33.

Figure 8:
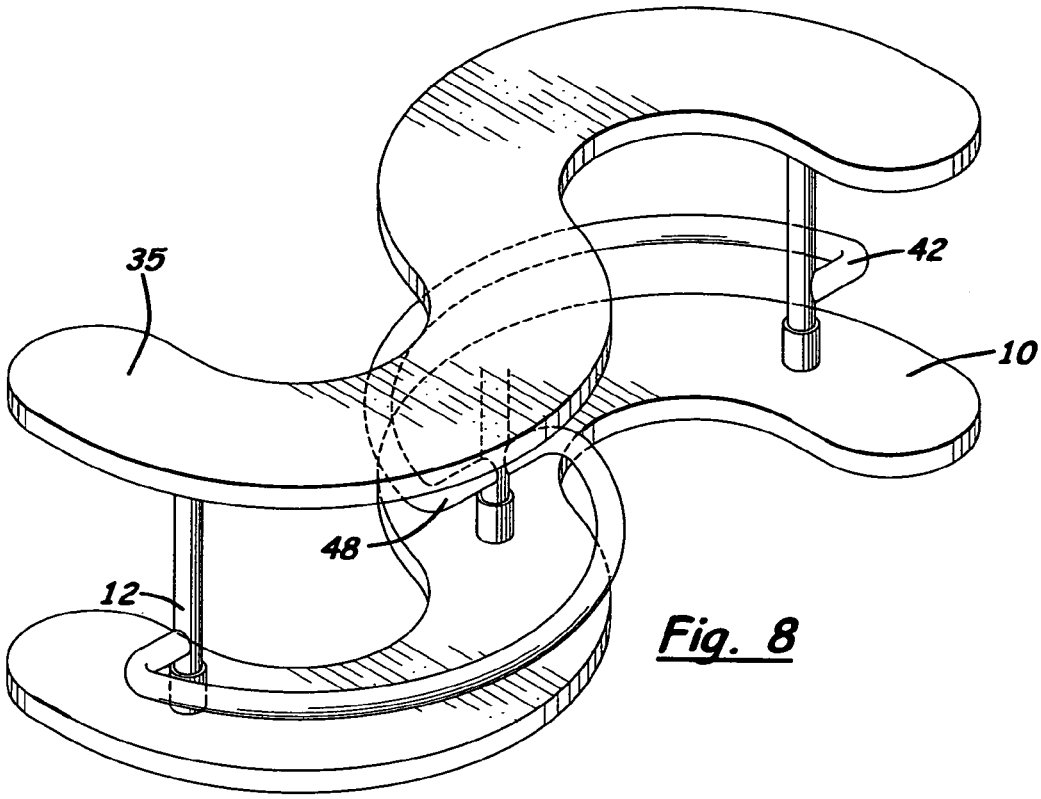
FIG. 8 shows a perspective view of another preferred embodiment of the pedestal of the subject invention.
Figure 9:
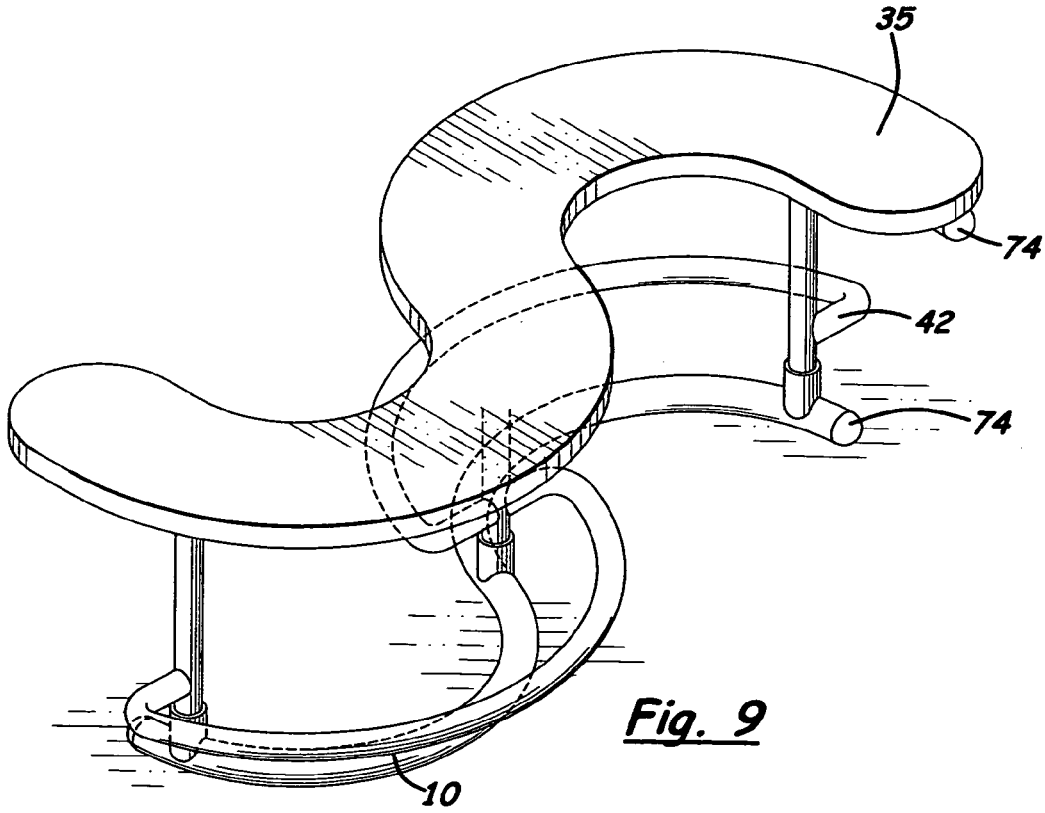
FIG. 9 shows a perspective view of another preferred embodiment of the pedestal of the subject invention.

FIGS. 8 and 9 show the pedestal of the subject invention as a bench. The furniture component is a bench seat 35. The bench can seat more than one person. In the exemplified embodiments, the S-shaped frame member 42 serves as a footrest for a seated person. Multiple benches can be connected to one another through sockets 74 at either end of the base and furniture component support. Additionally, pedestals can be stacked through sockets 76 and connectors (not shown) in the base and furniture component support sides. FIG. 9 illustrates that the bench can be constructed with like furniture component supports allowing the base to also be used as a seat when rotated 180 degrees.

Figure 10A:
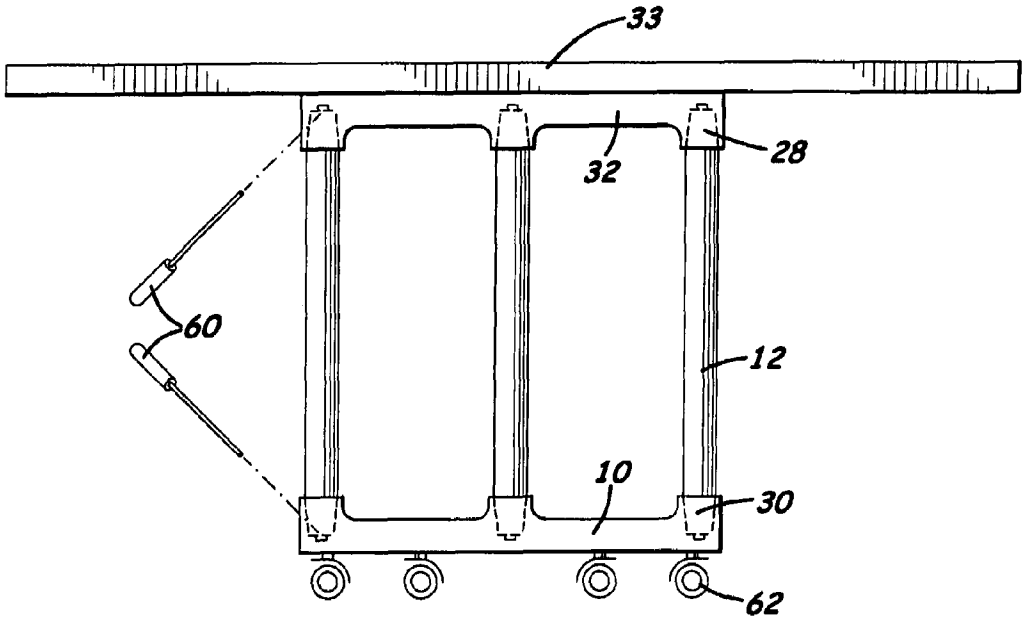
FIG. 10A shows a side elevational view of another particularly preferred embodiment of the pedestal of the subject invention.
Figure 10B:
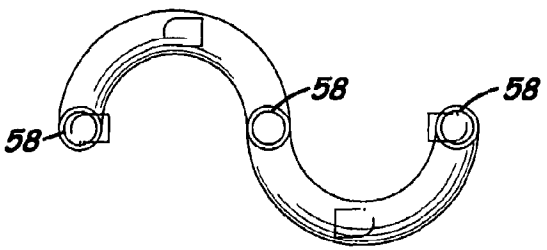
FIG. 10B shows a top sectional view alone line B-B of the embodiment of the pedestal shown in FIG. 10A.

FIGS. 10A and 10B show another preferred embodiment of the pedestal of the subject invention. In this embodiment, the S-shaped base 10 and furniture component support 32 are the same configuration. Thus the pedestal achieves a "standardization of parts" which positively affects the cost and complexity of the table. The base 10 and furniture component support 32 have a plurality of tapered sockets 58 to receive the upwardly extending support members 12 which are correspondingly tapered at their upper end 28 and lower end 30. The tapered sockets 58 are standard tapers known to those skilled in the art. The sockets can be "self-holding" tapers which have an angle of taper that varies only a few degrees, thus, the support members placed in the taper is seated so firmly in the socket that there is considerable frictional resistance to any force which tends to rotate or withdraw the leg relative to the socket. The taper is "self-holding." Examples of a "self-holding" taper useful according to the subject invention, include but are not limited to, Morse, Brown & Sharpe, Jarno and American National tapers.

To facilitate easy disassembly of the pedestals of the subject invention, the pedestals can include quick release mechanisms which dislodge the upwardly extending support members 12 from the tapered sockets 58 in the base 10 and furniture component support 32. These quick release mechanisms include a single opening in the socket 58 in which a lever 60 can be inserted near the end of the support member in the socket to pry the support from the taper. Opposing openings in the member provide a double fulcrum quick release mechanism. Additionally, the support member can be released from the taper by rotating a rod with a cam lobe which is disposed beneath the support member. Casters 62 allow the pedestal to be moved easily.

Figure 11A:
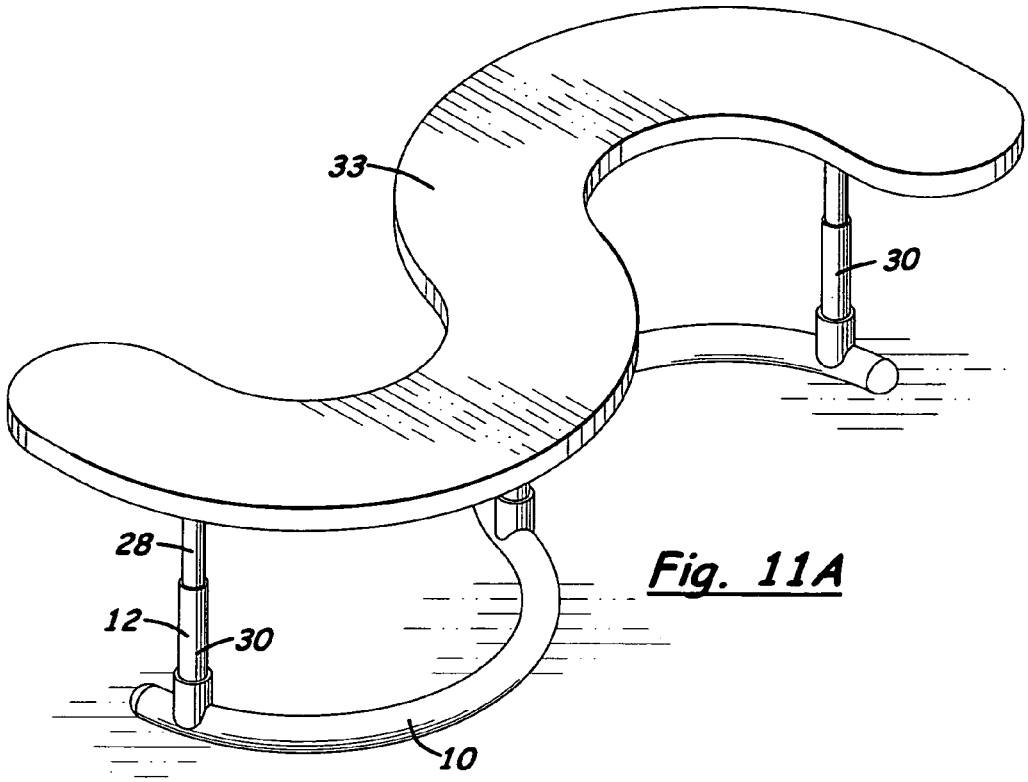
FIG. 11A shows a perspective view of another preferred embodiment of the pedestal of the subject invention.
Figure 11B:
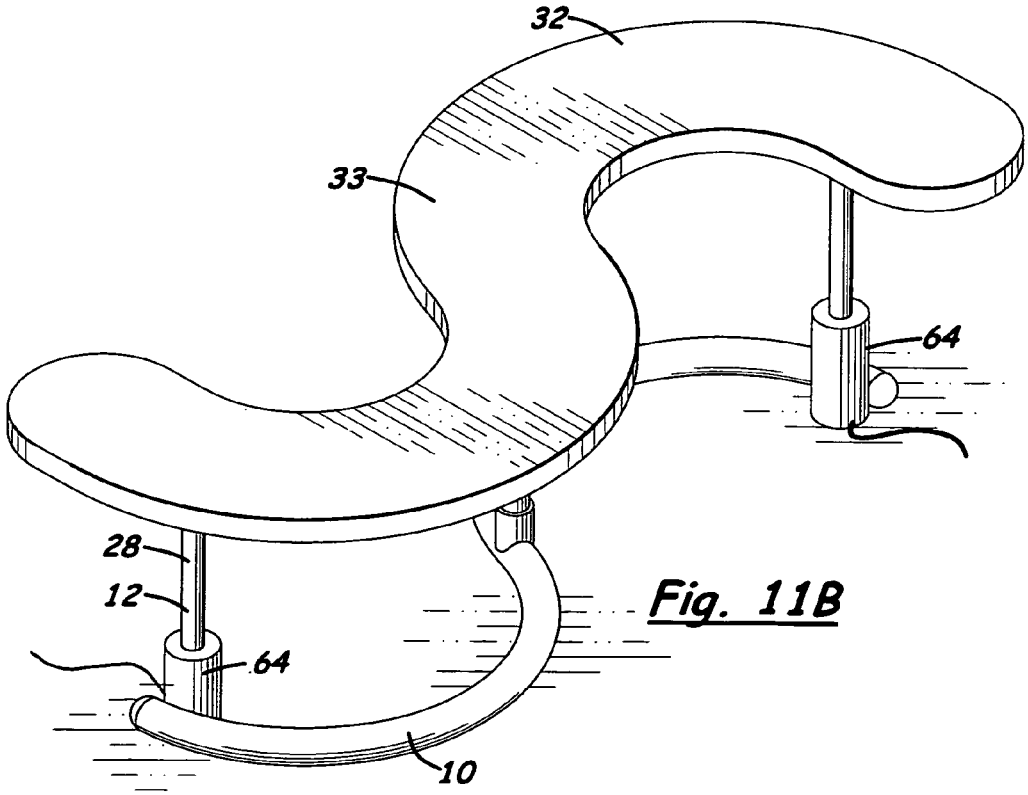
FIG. 11B shows a perspective view of another preferred embodiment of the pedestal of the subject invention.

FIGS. 11A and 11B show that the pedestal of the subject invention can be height adjustable. The upwardly extending support members 12 can be height adjustable telescoping mechanisms 64 whose upper end 28 moves away from the lower end 30. The height adjustable telescoping mechanisms can comprise resilient spring material. In a particularly preferred embodiment, the height adjustable telescoping mechanism is a gas spring. Further, the height adjustable telescoping mechanism 64 can be powered by, for example, a spring or an electromagnetic motor.

Figure 12:
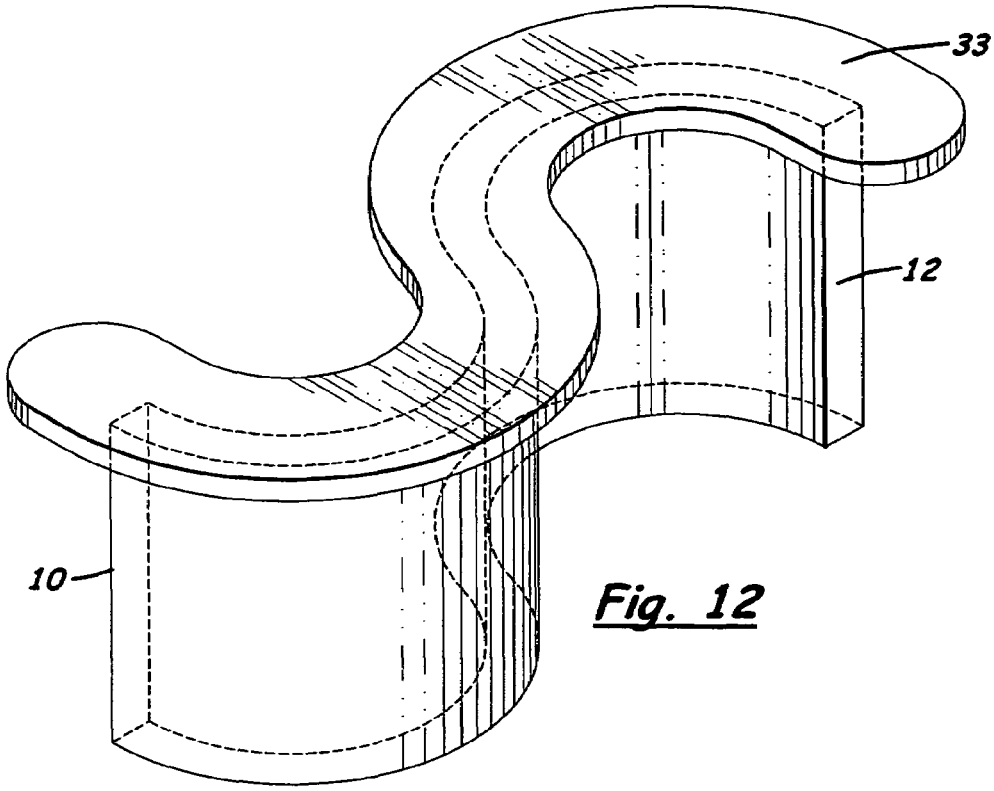
FIG. 12 shows a perspective view of another preferred embodiment of the pedestal of the subject invention.
Figure 13:
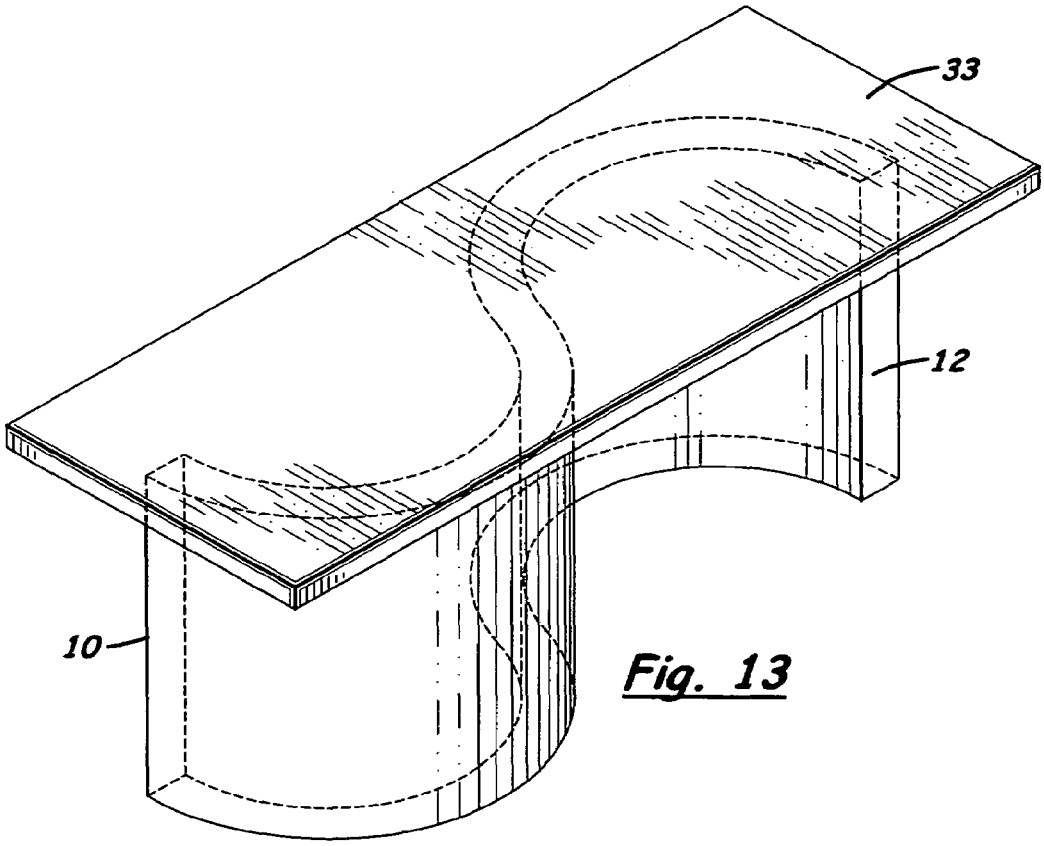
FIG. 13 shows a perspective view of another preferred embodiment of the pedestal of the subject invention.

FIGS. 12 and 13 show other preferred embodiments of the pedestal of the subject invention. In these embodiments, the base 10 and upwardly extending support members 12 are continuous panels offering modesty to a seated person and/or utility cord management.

Figure 15:
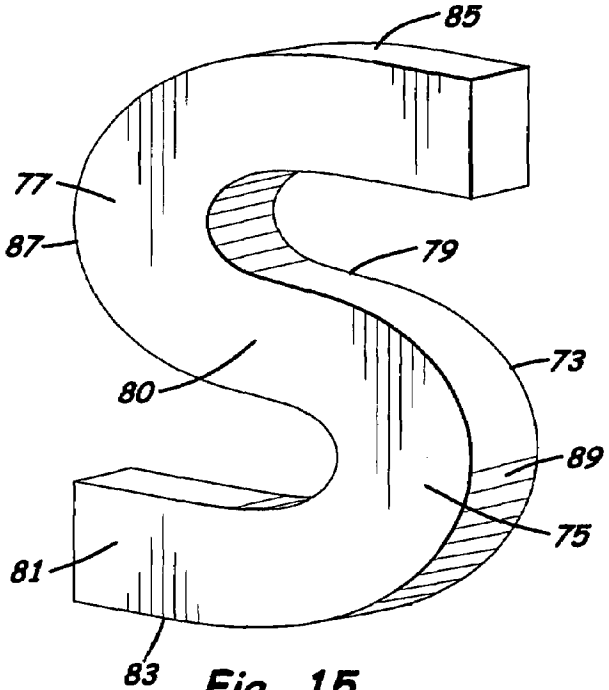
FIG. 15 shows a side elevational view of an S-shaped member of the subject invention.
Figure 14:
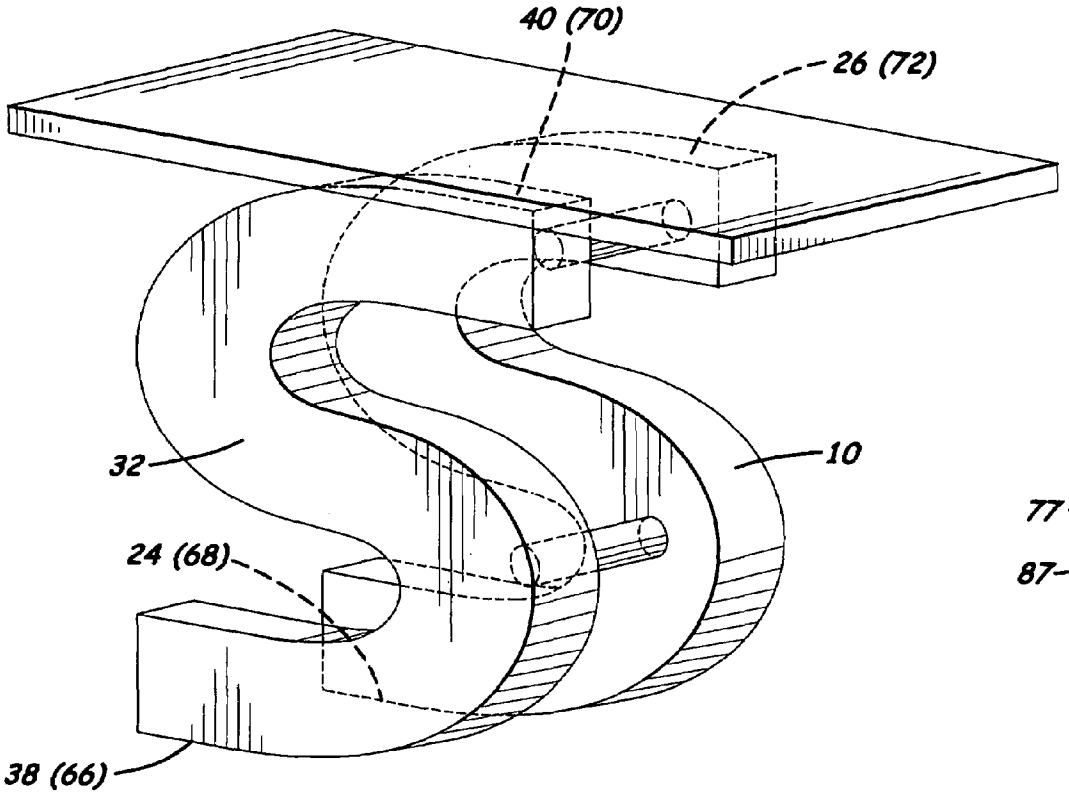
FIG. 14 shows a perspective view of another preferred embodiment of the pedestal of the subject invention.
Figure 16:
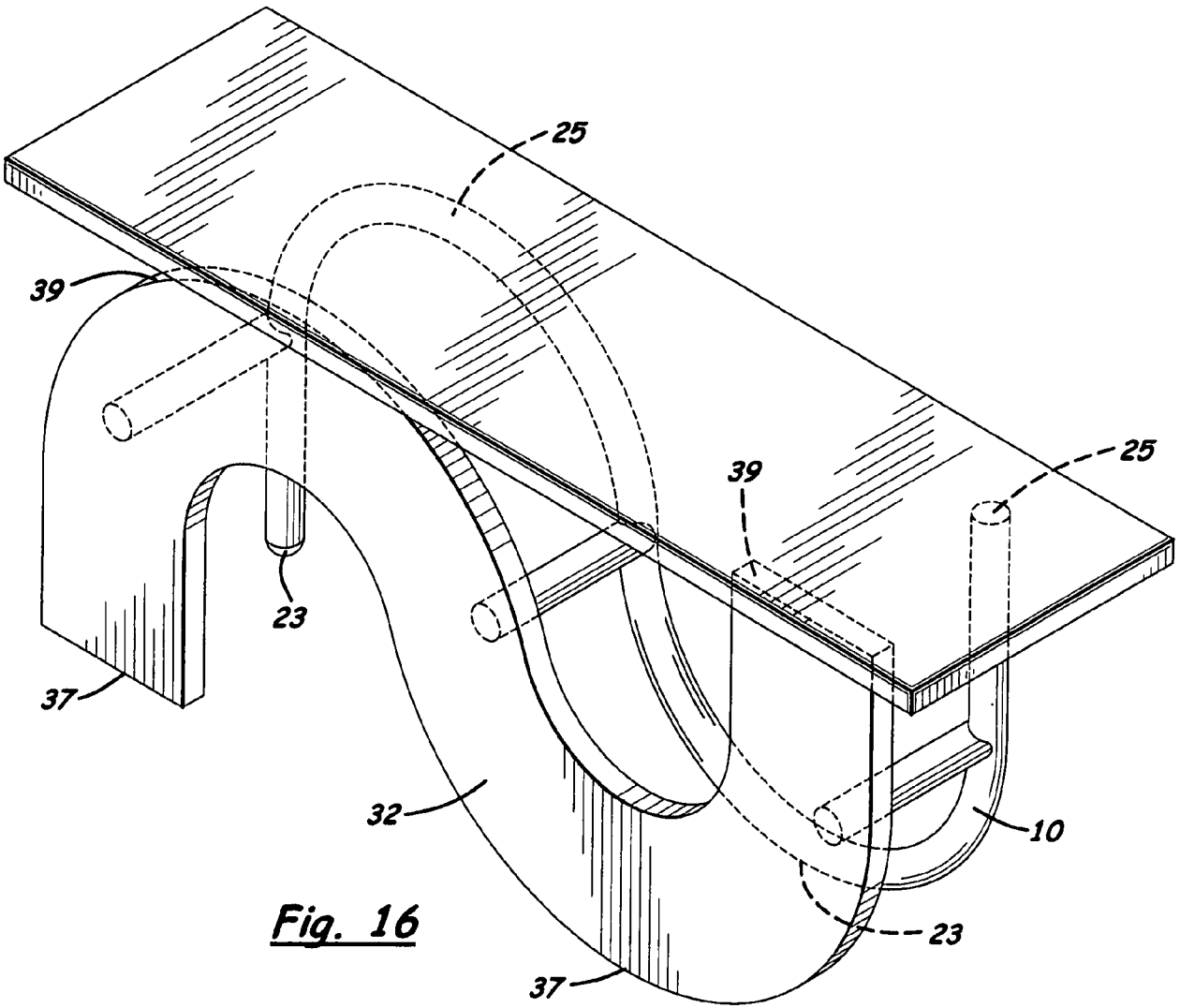
FIG. 16 shows a perspective view of another preferred embodiment of the pedestal of the subject invention.

FIG. 14 shows the pedestal of the subject invention rotated 90 degrees. One end 38 of the furniture component support 32 and one end 24 of the S-shaped base 10 are first and second base sections 66, 68, respectively. Opposing ends 40, 26 of the furniture component support 32 and base 10 are first and second furniture component support sections 70, 72, respectively. FIG. 15 shows an S-shaped member 73 serving as a pedestal. The S-Shaped frame member has a first arcuate section 75 and a second arcuate section 77 which interest in middle section 80. A first side 79 faces away from a second side 81. First and second opposing ends 83, 85 are orthogonal to the first and second sides. The S-shaped member further has opposing ends 87, 89. a FIG. 16 likewise shows the subject pedestal rotated 90 degrees, when opposing ends 23, 25 of the base and 37, 39 of the furniture component support become the base and furniture component support.

Figure 17:
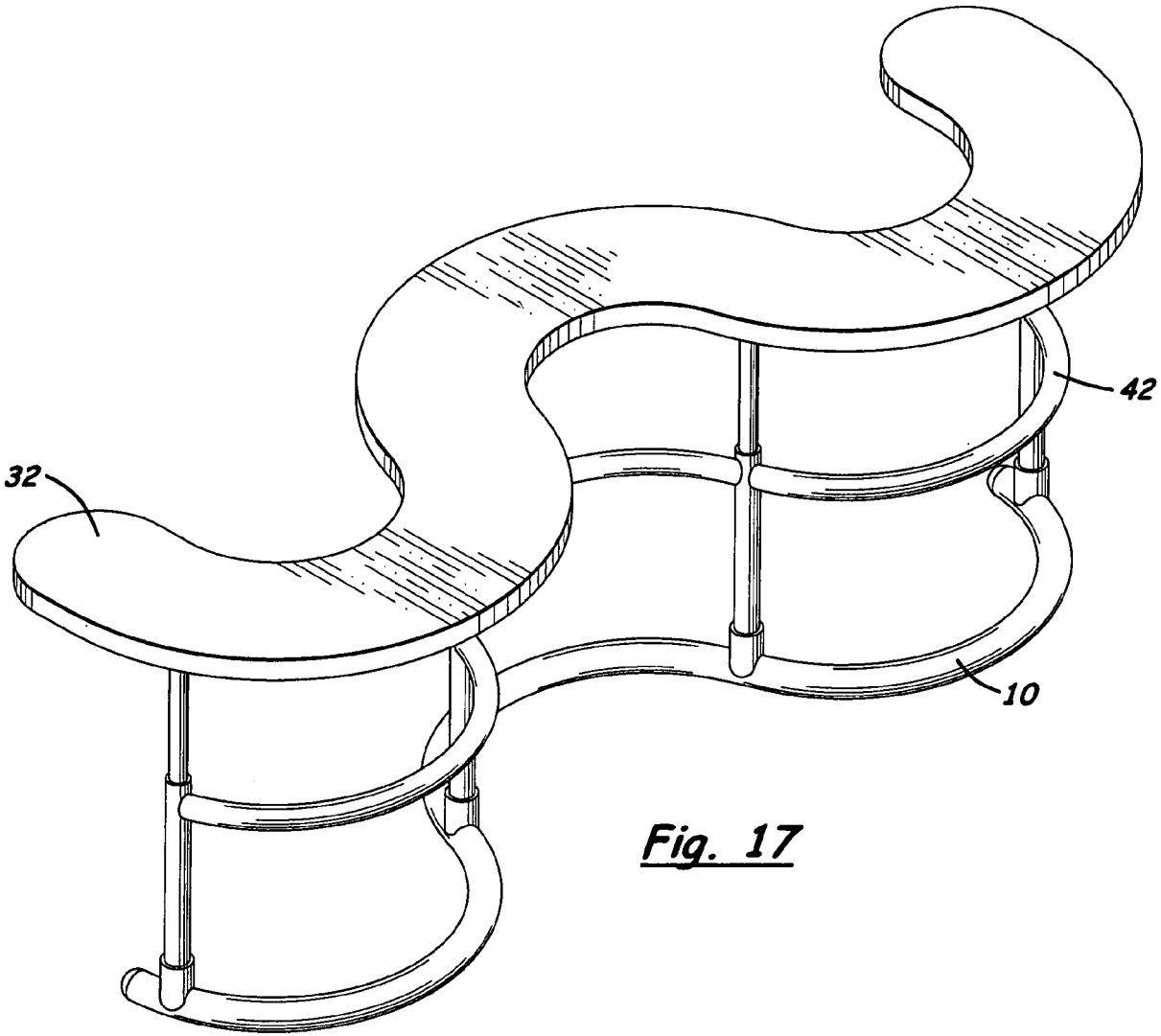
FIG. 17 shows a perspective view of another preferred embodiment of the pedestal of the subject invention.

FIG. 17 shows another preferred embodiment of the pedestal of the subject invention. FIG. 17 has a base 10, furniture frame member 42 and furniture component support 32 with three arcuate sections. A bench pedestal can be used with the table pedestal shown in FIG. 16 to provide seating that compliments the table.

Figure 18:
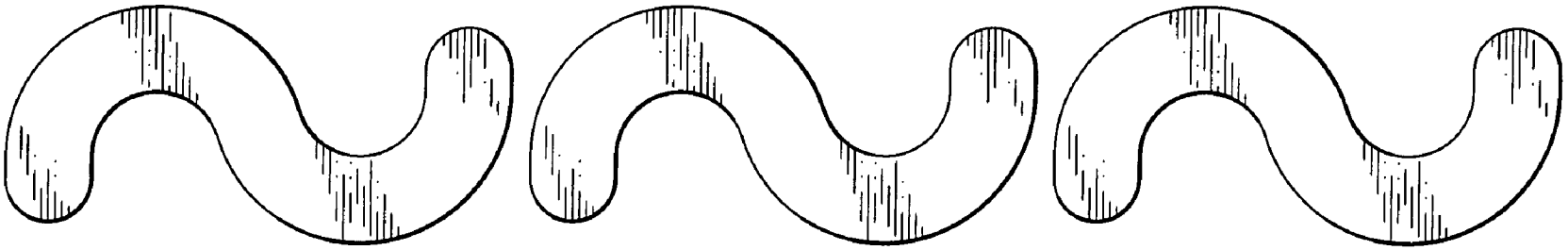
FIG. 18 shows a top plan view of multiple pedestals of the subject invention being used together.

FIG. 18 shows multiple pedestals of the subject invention used together. The pedestals provide adequate and private workspace in a limited area. The multiple pedestals are shown in a line that can be arranged in other patterns however to fit the work space or project design.

It is understood that the foregoing examples are merely illustrative of the present invention. Certain modifications of the articles and/or methods employed may be made and still achieve the objectives of the invention. Such modifications are contemplated as within the scope of the claimed invention.

The invention claimed is:

1. A pedestal comprising:

An S-shaped base comprising first and second opposing arcuate sections, and a middle section; wherein said opposing first and second arcuate sections intersect at said middle section; a first side and a second opposing side facing away from said first side; at least first and second opposing ends facing away from each other and respectively comprising said first and second opposing arcuate sections; wherein each opposing end is disposed orthogonal to said first and second opposing sides comprising said S-shaped base;

at least one upwardly extending furniture support member disposed above and supported by said S-shaped base; wherein each of said at least one upwardly extending furniture support member comprises upper and lower opposing ends; wherein said lower end of each upwardly extending furniture support member is supported by said S-shaped base;

a furniture component support; wherein said furniture component support is supported by said upper end of each of said at least one upwardly extending furniture support member; wherein said furniture component support comprises a first side and a second opposing side facing away from said first side; at least first and second opposing ends facing away from each other; wherein each opposing end is disposed orthogonal to said first and second opposing sides comprising said furniture component support.

2. The pedestal of claim 1, wherein said lower end of one said upwardly extending furniture support member is disposed above said middle section of said S-shaped base.

3. The pedestal of claim 1, wherein said furniture component support comprises an S-shaped furniture component support, comprising first and second opposing arcuate sections, and a middle section; wherein said first and second opposing arcuate sections intersect at said middle section; wherein each opposing end comprises said first and second opposing arcuate sections.

4. The pedestal of claim 1, comprising at least two said at least one upwardly extending furniture support members.

5. The pedestal of claim 1, comprising at least three said at least one upwardly extending furniture support members.

6. The pedestal of claim 1, wherein said furniture component support comprises a furniture component.

7. The pedestal of claim 1, comprising a furniture component disposed above and supported by said furniture component support.

8. The pedestal of claim 7, wherein said furniture component comprises an S-shaped furniture component comprising first and second opposing arcuate sections, and a middle section; wherein said opposing first and second arcuate sections intersect at said middle section; a first side and a second opposing side facing away from said first side; at least first and second opposing ends facing away from each other and respectively comprising said first and second opposing arcuate sections; wherein each opposing end is disposed orthogonal to said first and second opposing sides comprising said S-shaped furniture component.

9. A pedestal comprising:

An S-shaped base comprising first and second opposing arcuate sections, and a middle section; wherein said opposing first and second arcuate sections intersect at said middle section; a first side and a second opposing side facing away from said first side; at least first and second opposing ends facing away from each other and respectively comprising said first and second opposing arcuate sections; wherein each opposing end is disposed orthogonal to said first and second opposing sides comprising said S-shaped base;

at least one upwardly extending furniture support member disposed above and supported by said S-shaped base; wherein each of said at least one upwardly extending furniture support member comprises upper and lower opposing ends; wherein said lower end of each of said at least one upwardly extending furniture support member is supported by said S-shaped base;

a furniture component support; wherein said furniture component support is supported by said upper end of said at least one said upwardly extending furniture support member.

10. A pedestal comprising:

An S-shaped base comprising first and second opposing arcuate sections, and a middle section; wherein said opposing first and second arcuate sections intersect at said middle section; a first side and a second opposing side facing away from said first side, at least first and second opposing ends facing away from each other and respectively comprising said first and second opposing arcuate sections; wherein each opposing end is disposed orthogonal to said first and second opposing sides comprising said S-shaped base;

at least one of said at least one upwardly extending furniture support member disposed above and supported by said S-shaped base; wherein each of said at least one upwardly extending furniture support member comprises upper and lower opposing ends; wherein said lower end of said each upwardly extending furniture support member is supported by said S-shaped base;

a furniture component support; wherein said furniture component support is supported by said upper end of at least one said upwardly extending furniture support member; a furniture component disposed above and supported by said furniture component support; wherein said furniture component comprises an S-shaped furniture component comprising first and second opposing arcuate sections, and a middle section; wherein said opposing first and second arcuate sections intersect at said middle section; a first side and a second opposing side facing away from said first side; at least first and second opposing ends facing away from each other and respectively comprising said first and second opposing arcuate sections; wherein each opposing end is disposed orthogonal to said first and second opposing sides comprising said S-shaped furniture component.

* * * * *